US006202234B1

(12) United States Patent
Henderson

(10) Patent No.: US 6,202,234 B1
(45) Date of Patent: Mar. 20, 2001

(54) THERAPEUTIC PILLOW

(76) Inventor: Josephine Henderson, 19 Lee Ave., Haledon, NJ (US) 07508

( * ) Notice: Subject to any disclaimer, the term of this patent is extended or adjusted under 35 U.S.C. 154(b) by 0 days.

(21) Appl. No.: 09/186,648

(22) Filed: Nov. 6, 1998

(51) Int. Cl.[7] ..... A47C 20/02
(52) U.S. Cl. ..... 5/653; 5/654; 5/909; 297/452.26
(58) Field of Search ..... 5/653, 654, 644, 5/655.5, 909; 297/452.25, 452.26

(56) References Cited

U.S. PATENT DOCUMENTS 3,305,878 * 2/1967 Hellbaum ..... 5/653
4,726,624 * 2/1988 Jay ..... 5/654 X
4,753,480 * 6/1988 Morell ..... 5/653 X
5,412,822 * 5/1995 Kelly ..... 5/654 X
5,630,240 * 5/1997 Matsuoka et al. ..... 5/653
5,636,395 * 6/1997 Serda ..... 5/655.5 X

* cited by examiner

*Primary Examiner*—Terry Lee Melius
*Assistant Examiner*—James M Hewitt

(57) ABSTRACT

A therapeutic pillow for placing on a seat and for being sat upon by a user and for supporting the tail bone of the user and for cradling the buttocks of the user to assure that support for the tail bone of the user is held in place. The pillow includes a base, a support, and a pair of bolsters. The base overlies the seat. The support is disposed axially along the base and supports the tail bone of the user. The pair of bolsters extend axially along the base, straddle the support, cradle the buttocks of the user therebetween so as to assure that the support is held in place under the tail bone of the user, by minimizing lateral movement of the user.

3 Claims, 3 Drawing Sheets

THERAPEUTIC PILLOW

BACKGROUND OF THE INVENTION

1. Field of the Invention

The present invention relates to a therapeutic pillow. More particularly, the present invention relates to a therapeutic pillow for sitting upon that supports the tail bone and cradles the buttocks for assuring that support for the tail bone is held securely in place.

2. Description of the Prior Art

One of the most debilitating ailments that human beings must endure is back pain. It can become so severe that people are unable to walk or make any movement without suffering tremendous discomfort. Even mild lower back pain can make it difficult to perform daily tasks.

Back problems are the single most costly work place injury. Office workers are especially vulnerable to back injuries and muscle disorders due to the long hours they spend sitting down. In 1990, back cases represented 32% of all workers' compensation claims, and the average cost of back claims was 50% higher than that of other work-related injuries. Further, according to a recent study, the risk of a disabling episode of back pain is so common that nearly 80% of adults experience one or more episodes during their life times.

In early years, consumers spent a substantial amount of money on medical products and prescription drugs in an attempt to reduce lower back pain. One of the biggest problems with pain medicine is that it can inflict an assortment of side effects that can leave the user feeling drowsy and unable to function normally.

Millions of people have suffered lower back pain for many years. In most. cases, the products that are already on the market fail to provide substantial relief.

Numerous innovations for back devices have been provided in the prior art. Even though these innovations may be suitable for the specific individual purposes to which they address, they differ from the present invention in that they do not teach a therapeutic pillow for sitting on that supports the tail bone and cradles the buttocks for assuring the support for the tail bone is held securely in place.

FOR EXAMPLE, U.S. Pat. No. 4,516,568 to Baxter et al. teaches a pressure exerting device comprising a resilient wedge shaped member and modified U-shape air bladder which may be filled to a selected air pressure and exerts a pre-selected pressure in a uniform manner over selected lumbar and sacroiliac areas of the body.

ANOTHER EXAMPLE, U.S. Pat. No. 4,718,727 to Sheppard teaches a reversible seat supplement, or seat cushion and/or backrest, that includes upper and lower portions which are both contoured, generally concave on one side and convex on the other side; and a keyhole shaped opening including an enlarged opening toward the rear at the base of the spine and the coccyx, and a narrow slot for the anal and urogenital triangle region extending forward to a point more than half way across the seat. Wedge shaped openings angling forward and outward from the central portion of the seat avoid pressure on the sciatic nerves. An optional front vertical opening may be provided to receive a container for a cup of coffee or the like. Bulky material from the seat or the backrest prevent the backrest from flopping forward onto the seat, thus limiting normal folding of the seat back to about 90 degrees from the horizontal seat/pad. The seat back has optional devices to adjust the lumbar pressure. The seat and back portions have a device for alternately combining the reverse sides of the opposite portions to achieve a more personally sizable unit, with the option to use either portion separately as singular reversible unit.

STILL ANOTHER EXAMPLE, U.S. Pat. No. 5,337,427 to Pagano et al. teaches a birthing board which is portable, simple, and inexpensive. The birthing board has a top surface, a bottom surface, a front end and a back end with the front end being substantially thicker than the back end, so that the top surface is generally inclined from the back end to the front end. The top surface is curved to provide lumbar and pelvic support along a central axis which extends from the front end to the back end, and has a concave shape to support a woman's buttocks and hips in the vicinity of the front end and in a dimension transverse to the central axis. The front end is recessed in the vicinity of the central axis. The bottom surface of the board is convex in shape in a dimension transverse to the central axis and generally level in dimension parallel to the central axis.

YET ANOTHER EXAMPLE, U.S. Pat. No. 5,402,545 to Jolley teaches an orthopedic seat cushion for permitting free circulation and protecting the user's coccyx comprising a unitary body formed of expanded polymeric foam and a skin enclosing said foam is disclosed.

STILL YET ANOTHER EXAMPLE, U.S. Pat. No. 5,482,355 to Franzen Jr. teaches an orthopedic pillow for helping to correct and helping to prevent hyperkyphosis and rigidity of the thoracic spine and for returning the normal lordotic cervical curve that comprises a base panel having a first end portion, a second end portion, a left top surface segment extending between the first end portion and the second end portion, and a right top surface segment extending between the first end portion and the second end portion, a first crown for supporting the thoracic spine, the first crown being formed on the first end portion of the base panel, extending toward the second end portion of the base panel, and dividing at least partially the left top surface segment from the right top surface segment, and a transition ramp formed in the first end portion of the first crown for supporting the spine just under and below the shoulder blades of a reclining person. Other embodiments of the invention include a cylindrical pillow having a transition ramp, a removable pillow apparatus for supporting the neck of a person sitting in a bucket seat of a car, and a chair having a pillow having a substantially semi-cylindrical shape with a center axis that extends between its upper end portion and its lower end portion.

YET STILL ANOTHER EXAMPLE, U.S. Pat. No. 5,630,239 to Franzen Jr. teaches an orthopedic pillow for helping to correct and helping to prevent hyperkyphosis and rigidity of the thoracic spine and for returning the normal lordotic cervical curve that comprises a base panel having a first end portion, a second end portion, a left top surface segment extending between the first end portion and the second end portion, and a right top surface segment extending between the first end portion and the second end portion, a first crown for supporting the thoracic spine, the first crown being formed on the first end portion of the base panel, extending toward the second end portion of the base panel, and dividing at least partially the left top surface segment from the right top surface segment, and a transition ramp formed in the first end portion of the first crown for supporting the spine just under and below the shoulder blades of a reclining person. Other embodiments of the invention include a cylindrical pillow having a transition ramp, a removable pillow apparatus for supporting the neck of a person sitting in a bucket seat of a car, and a chair having a pillow having a substantially semi-cylindrical shape with a center axis that extends between its upper end portion and its lower end portion.

FINALLY, STILL YET ANOTHER EXAMPLE, U.S. Pat. No. 5,702,153 to Pliska teaches a tailbone cushion to eliminate discomfort of patients afflicted with hemorrhoids, fissure, damaged coccyges (tailbone) or the like associated with sitting on hard surfaces. The tail bone cushion of the present invention consists of a cushion section having front, rear and side edges and generally flat top and generally flat top and bottom surfaces. The cushion section has a cutout centrally disposed in the rear edge providing said cushion section with a U-shaped configuration. The cutout is sized and located to eliminate contact between the patient's tailbone and either the cushion or the surface underneath the cushion. The cushion section is preferably tapered in thickness and firmness from rear to front. The cushion section is also preferably formed from a casing filled with a material that has low compression under a patient's body weight yet soft enough to permit sitting for extended periods with minimal discomfort. The tail bone cushion is optionally provided with a back support. The back support has top, bottom and side edges generally flat from and rear surfaces. The back support is preferably detachably connected to the cushion section by a hinged connection between the rear edge of the cushion section and the bottom edge of the back support to permit the tailbone cushion to be folded flat for storage or transport and opened for use. Means may be provided with said back support to provide a lumbar support preferably a hot pack. The means can include a sleeve or pouch located on the front surface of said back support.

It is apparent that numerous innovations for back devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

The present invention is designed to provide relief to people with a common physical ailment. By sitting on the soft, molded product, the user eases lower back pain by reducing pressure to the tail bone.

The present invention is a pillow that is approximately 8 to 10" long, 5 to 7" wide, and 3 to 5" thick. The feature that alleviates pain to the tail bone is an insert that is approximately 1.5 to 2" long. The insert is made of a malleable, but firm, gel and placed into a mold to conform to each individual's tail bone. The molded gel is covered by a soft material and inserted into the pillow. The insert is kept secure to prevent movement of the product.

By using the molded, gel-like substance that would be shaped to fit the consumer's tail bone, stress on the lower back area is reduced, thereby easing any discomfort. The protruding insert of the present invention is placed against the user's tail bone and held securely n place to provide maximum comfort.

By using the present invention, users will remain alert and drug-free, while providing relief that is more effective and more permanent than prescription drugs. Users of the present invention would also realize substantial savings by eliminating the need to purchase medicine.

The present invention is simple to use. Unlike other therapeutic or medical products that can be bulky or cumbersome to operate or apply, the present invention is easy to use and requires little effort. Once the user is sitting comfortably, their work is done!

In addition to relieving pain to the lower back, the present invention can also aid in the prevention of further pain in that area. By using the present invention regularly, the user would be providing support to the tail bone, keeping it healthy and free of pain.

ACCORDINGLY, AN OBJECT of the present invention is to provide a therapeutic pillow that avoids the disadvantages of the prior art.

ANOTHER OBJECT of the present invention is to provide a therapeutic pillow that is simple and inexpensive to manufacture.

STILL ANOTHER OBJECT of the present invention is to provide a therapeutic pillow that is simple to use.

BRIEFLY STATED, YET ANOTHER OBJECT of the present invention is to provide a therapeutic pillow for placing on a seat and for being sat upon by a user and for supporting the tail bone of the user and for cradling the buttocks of the user to assure that the support for the tail bone of the user is held in place. The pillow includes a base, a support, and a pair of bolsters. The base overlies the seat. The support is disposed axially along the base and supports the tail bone of the user. The pair of bolsters extend axially along the base, straddle the support, cradle the buttocks of the user therebetween so as to assure that the support is held in place under the tail bone of the user, by minimizing lateral movement of the user.

The novel features which are considered characteristic of the present invention are set forth in the appended claims. The invention itself, however, both as to its construction and its method of operation, together with additional objects and advantages hereof, will be best understood from the following description of the specific embodiments when read and understood in connection with the accompanying drawings.

DESCRIPTION OF THE DRAWINGS

The figures of the drawing are briefly described as follows.

LIST OF REFERENCE NUMERALS

UTILIZED IN THE DRAWING

Figure 1:
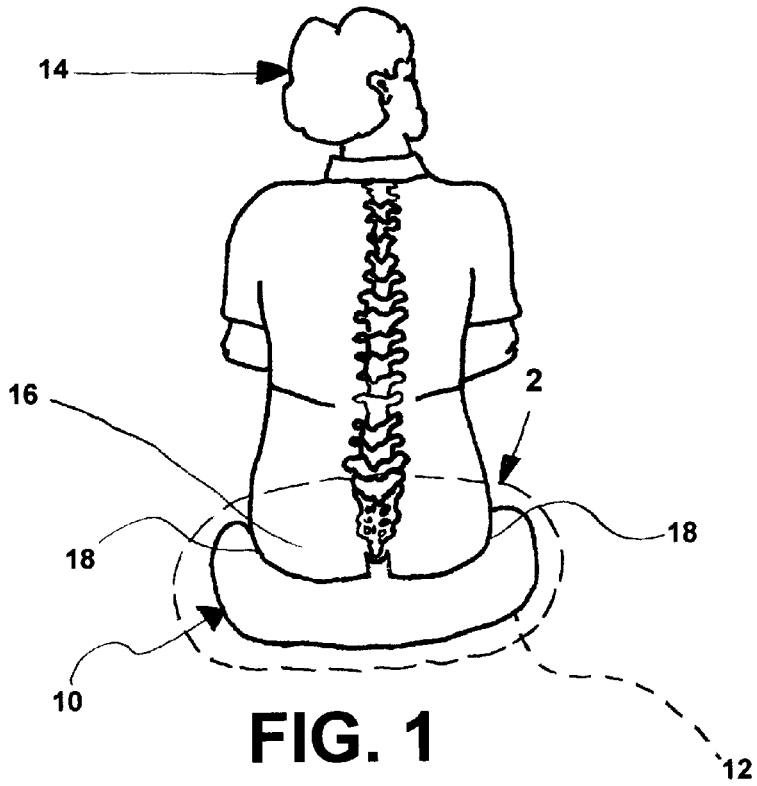
FIG. 1 is a diagrammatic perspective view of the present invention being sat upon and supporting the tail bone and cradling the buttocks for assuring that the support for the tail bone is held in place.

10 therapeutic pillow of the present invention
12 seat
14 user
16 tail bone of user 14
18 buttocks of user 14
20 base for overlying seat 12
22 support for supporting tail bone 16 of user 14

24 pair of bolsters for cradling buttocks 18 of user 14 therebetween so as to assure that support 22 is held in place under tail bone 16 of user 14, by minimizing lateral movement of user 14
26 lower face of base 20 for overlying seat 12
28 upper face of base 20 for sitting upon by user 14
30 pair of axial edges of lower face 26 of base 20
32 pair of axial edges of upper face 28 of base 20
34 axial centerline of upper face 28 of base 20
36 lower face of support 22
38 pair of axial edges of lower face 36 of support 22
40 pair of lateral edges of lower face 36 of support 22
42 pair of axial side walls of support 22
44 pair of lateral end walls of support 22
46 top wall of support 22

DESCRIPTION OF THE PREFERRED EMBODIMENT

Figure 2:
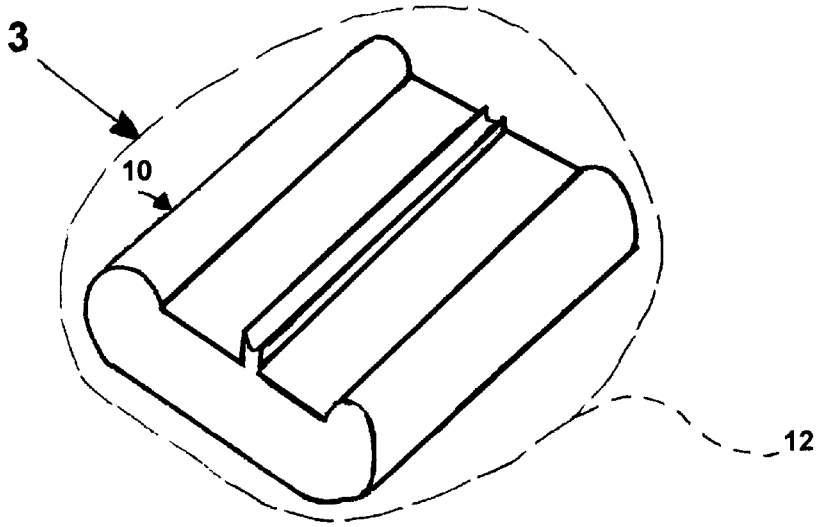
FIG. 2 is an enlarged diagrammatic perspective view of the area generally enclosed by the dotted ellipse identified by ARROW 2 in FIG. 1 of the present invention ready for use.

Referring now to the figures, in which like numerals indicate like parts, and particularly to FIGS. 1 and 2, which are, respectively, a diagrammatic perspective view of the present invention being sat upon and supporting the tail bone and cradling the buttocks for assuring that the support for the tail bone is held in place, and an enlarged diagrammatic perspective view of the area generally enclosed by the dotted ellipse identified by ARROW 2 in FIG. 1 of the present invention ready for use, the therapeutic pillow of the present invention is shown generally at 10 for placing on a seat 12 and for being sat upon by a user 14 and for supporting the tail bone 16 of the user 14 and for cradling the buttocks 18 of the user 14 to assure that the support for the tail bone 16 of the user 14 is held in place.

Figure 3:
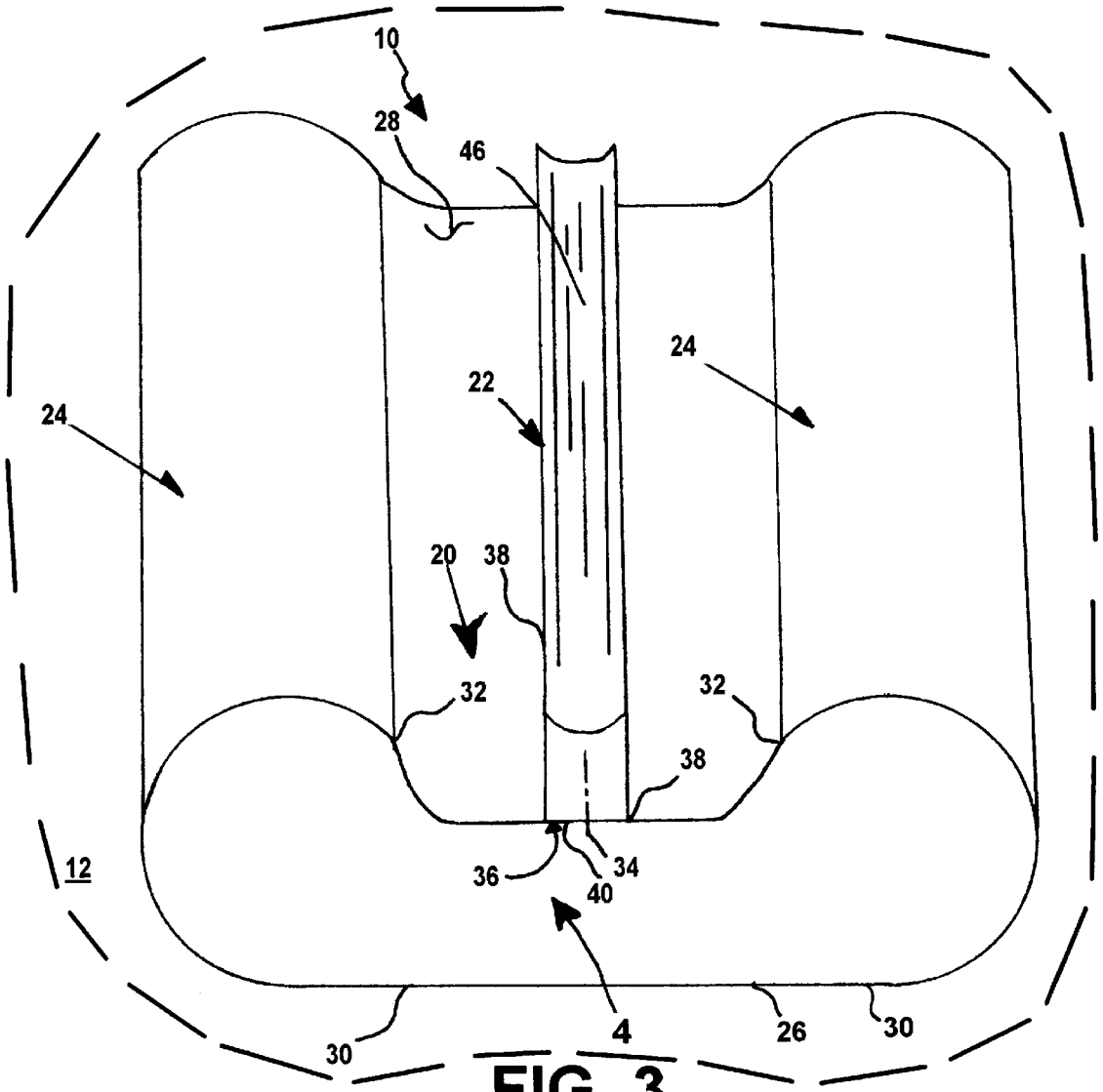
FIG. 3 is an enlarged diagrammatic perspective view of the area generally enclosed by the dotted ellipse identified by ARROW 3 in FIG. 2 of the present invention.
Figure 4:
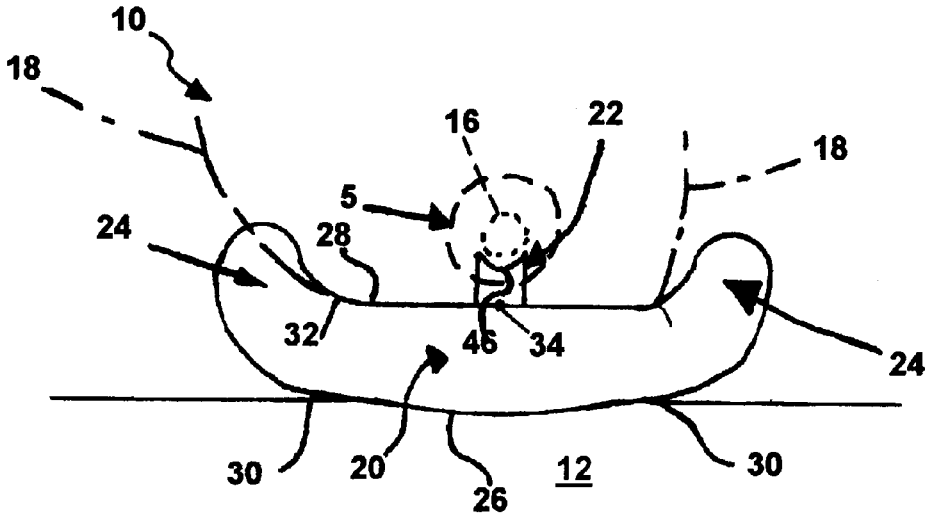
FIG. 4 is a reduced diagrammatic front elevational view taken generally in the direction of ARROW 4 in FIG. 3.
Figure 5:
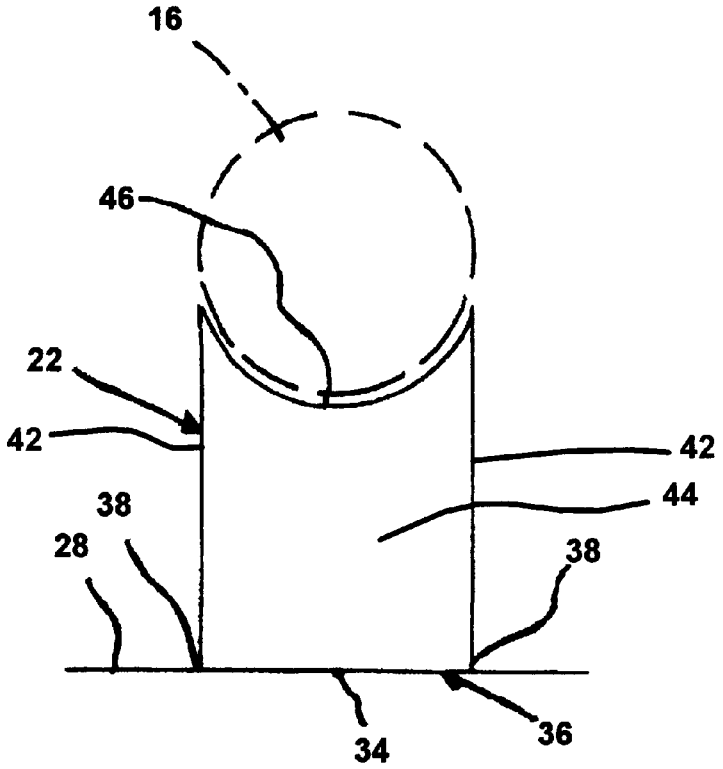
FIG. 5 is an enlarged diagrammatic front elevational view of the area generally enclosed by the dotted ellipse identified by ARROW 5 in FIG. 4.

The configuration of the therapeutic pillow 10 can best be seen in FIGS. 3–5, which are, respectively, an enlarged diagrammatic perspective view of the area generally enclosed by the dotted ellipse identified by ARROW 3 in FIG. 2 of the present invention, a reduced diagrammatic front elevational view taken generally in the direction of ARROW 4 in FIG. 3, and an enlarged diagrammatic front elevational view of the area generally enclosed by the dotted ellipse identified by ARROW 5 in FIG. 4, and as such, will be discussed with reference thereto.

The therapeutic pillow 10 comprises a base 20 for overlying the seat 12, a support 22 disposed axially along the base 20 for supporting the tail bone 16 of the user 14, and a pair of bolsters 24 extending axially along the base 20 straddling the support 22 and for cradling the buttocks 18 of the user 14 therebetween so as to assure that the support 22 is held in place under the tail bone 16 of the user 14 by minimizing lateral movement of the user 14.

The base 20 is thin and generally rectangular-parallelepiped-shaped, and has a lower face 26 for overlying the seat 12 and an upper face 28 that is disposed above the lower face 26 of the base 20 for sitting upon by the user 14.

The lower face 26 of the base 20 has a pair of axial edges 30, and the upper face 28 of the base 20 has a pair of axial edges 32 and an axial centerline 34.

The support 22 is a molded firm gel covered by a soft material.

The support 22 is narrow and has a lower face 36 that extends along the centerline 34 of the lower face 26 of the base 20. The lower face 36 of the support 22 has a pair of axial edges 38 and a pair of lateral edges 40.

The support 22 further has a pair of axial side walls 42 that extend vertically upwardly from the pair of axial edges 38 of the lower face 36 of the support 22, respectively.

The support 22 further has a pair of lateral end walls 44 that extend vertically upwardly from the pair of lateral edges 40 of the lower face 36 of the support 22, respectively, and meet the pair of axial side walls 42 of the support 22, respectively.

The support 22 further has a top wall 46 that extends generally horizontally from one axial side wall of the pair of axial side walls 42 of the support 22 to the other axial side wall of the pair of axial side walls 42 of the support 22, and from one lateral end wall of the pair of lateral end walls 44 of the support 22 to the other lateral end wall of the pair of lateral end walls 44 of the support 22, and has an axial profile that extends from the one lateral end wall of the pair of lateral end walls 44 of the support 22 to the other lateral end wall of the pair of lateral end walls 44 of the support 22, a lateral profile that extends from the one axial side wall of the pair of axial side walls 42 of the support 22 to the other axial side wall of the pair of axial side walls 42 of the support 22, and an entire length.

The axial profile of the top wall 46 of the support 22 is straight along the entire length of the top wall 46 of the support 22, while the Lateral profile of the top wall 46 of the support 22 is concave along the entire length of the top wall 46 of the support 22 for substantially matching the somewhat circular periphery of the tail bone 16 of the user 14 so as to provide maximum support for the tail bone 16 of the user 14 without discomfort.

Each bolster of the pair of bolsters 24 is substantially cylindrically-shaped and extends from a respective axial edge of the pair of axial edges 30 of the lower face 26 of the base 20 convexly outwardly therefrom, convexly upwardly past the upper face 28 of the base 20, then convexly inwardly and downwardly to a respective axial edge of the pair of axial edges 32 of the upper face 28 of the base 20 for cradling the buttocks 18 of the user 14 so as to assure that the support 22 is held in place under the tail bone 16 of the user 14, by minimizing lateral movement of the user 14.

It will be understood that each of the elements described above, or two or more together, may also find a useful application in other types of constructions differing from the types described above.

While the invention has been illustrated and described as embodied in a therapeutic pillow, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A therapeutic pillow for placing on a seat and for being sat upon by a user, wherein the user has buttocks and a tail bone with a somewhat circular periphery, and for supporting the tail bone of the user and for cradling the buttocks of the user to assure that support for the tail bone of the user is held in place, said pillow comprising:

a) a base for overlying the seat; said base being thin and generally rectangular-parallelepiped-shaped and having a lower face for overlying the seat and an upper face disposed above said lower face of said base for sitting upon by the user; said lower face of said base having a pair of axial edges and said upper face of said base having a pair of axial edges and an axial centerline;

b) a support disposed axially along said base for supporting the tail bone of the user; said support being narrow and having a lower face extending along said centerline of said upper face of said base; said lower face of said support having a pair of axial edges and a pair of lateral edges; said support further having a pair of axial side walls extending vertically upwardly from said pair of axial edges of said lower face of said support, respectively; said support further having a pair of lateral end walls extending vertically upwardly from said pair of lateral edges of said lower face of said support, respectively, and meeting said pair of axial side walls of said support, respectively; said support further having a top wall extending generally horizontally from one axial side wall of said pair of axial side walls of said support to the other axial side wall of said pair of axial side walls of said support and from one lateral end wall of said pair of lateral end walls of said support to the other lateral end wall of said pair of lateral end walls of said support and having an axial profile extending from said one lateral end wall of said pair of lateral end walls of said support to said other lateral end wall of said pair of lateral end walls of said support, a lateral profile extending from said one axial side wall of said pair of axial side walls of said support to said other axial side wall of said pair of axial side walls of said support, and an entire length; said axial profile of said top wall of said support being straight along said entire length of said top wall of said support while said lateral profile of said top wall of said support being concave along said entire length of said top wall of said support relative to said pair of axial side walls of said support and said base when having a viewing position being right side up with said base being positioned below said top wall of said support for substantially matching the somewhat circular periphery of the tail bone of the user so as to provide maximum support for the tail bone of the user without discomfort; and c) a pair of bolsters extending axially along said base, straddling said support, for cradling the buttocks of the user therebetween so as to assure that said support is held in place under the tail bone of the user by minimizing lateral movement of the user.

2. The pillow as defined in claim 1, wherein said support is a molded firm gel covered by a soft material.

3. The pillow as defined in claim 1, wherein each bolster of said pair of bolsters is substantially cylindrically-shaped and extends from a respective axial edge of said pair of axial edges of said lower face of said base convexly outwardly therefrom, convexly upwardly past said upper face of said base, then convexly inwardly and downwardly to a respective axial edge of said pair of axial edges of said upper face of said base for cradling the buttocks of the user so as to assure that said support is held in place under the tail bone of the user, by minimizing lateral movement of the user.

* * * * *